US006862960B2

(12) United States Patent
Chung

(10) Patent No.: US 6,862,960 B2
(45) Date of Patent: Mar. 8, 2005

(54) JAR OPENER

(76) Inventor: Lap-Yan Chung, 4 Earls Lane, Kelsall, Tarporley, Cheshire (GB), CW6 0QR ( * ) Notice: Subject to any disclaimer, the term of this patent is extended or adjusted under 35 U.S.C. 154(b) by 0 days.

(21) Appl. No.: 10/665,863

(22) Filed: Sep. 18, 2003

(65) Prior Publication Data

US 2004/0055426 A1 Mar. 25, 2004

(51) Int. Cl.[7] ..... B25B 7/14
(52) U.S. Cl. ..... 81/336; 81/3.32; 81/3.43
(58) Field of Search ..... 81/336, 3.31, 3.32, 81/3.36, 3.391, 3.43, 64, 332, 333, 334, 335, 337, 338

(56) References Cited

U.S. PATENT DOCUMENTS

| | | | | | |
|---|---|---|---|---|---|
| 1,348,532 | A | * | 8/1920 | Arndt | 81/3.43 |
| 4,082,016 | A | * | 4/1978 | Vonusa | 81/3.43 |
| 5,203,236 | A | * | 4/1993 | Anderson | 81/3.2 |
| 6,101,903 | A | * | 8/2000 | Negley et al. | 81/64 |

FOREIGN PATENT DOCUMENTS

| | | |
|---|---|---|
| EP | 0 727 387 A1 | 8/1996 |
| WO | WO 95/30620 | 11/1995 |

* cited by examiner

*Primary Examiner*—Lee D. Wilson
*Assistant Examiner*—Alvin J. Grant
(74) *Attorney, Agent, or Firm*—Gerald E. Hespos; Anthony J. Casella

(57) ABSTRACT

A device for loosening threaded lids from correspondingly threaded containers, comprising a body carrying first and second flexible belts (20, 26) forming first and second loops which engage around the lid and the container respectively, the belts (20, 26) being arranged to be relatively displaceable such that the first and second loops grip the lid and the container respectively, the belts further being arranged to be displaceable by an actuating means such that the first and second loops apply oppositely directed torques to the lid and container respectively whereby the lid is rotated on the container in a loosening direction. Both the lid and the container are thus gripped by the device rather than by hand. The loosening of the lid may be achieved by the rotation of only one of the loops relative to the body, the other loop serving to prevent rotation of the lid or the container relative to the body. Alternatively, both of the loops may rotate relative to the body in opposite directions.

18 Claims, 4 Drawing Sheets

JAR OPENER

DESCRIPTION

The present invention relates to a device for loosening threaded lids. In particular, the invention relates to a device for loosening lids from jars.

It is common for containers, e.g. jam jars, to be provided with a threaded lid which engages with a thread on the neck of the container to form an air-tight seal. In order to form the seal, it is necessary for the lid to be screwed tightly onto the container. It is also common for the pressure in the container to be reduced below atmospheric pressure to assist in forming the seal. As a result, it is sometimes difficult to remove the lid from the container manually, particularly for those with reduced manual dexterity, e.g. the elderly or those suffering with arthritis, etc.

A number of devices are known whose aim is to overcome this problem. Some such devices are disclosed in EP0741104A1, WO95/30620, EP0358869A1, EP0727387A1, WO97/16373 and EP0320191A1.

Some of these devices suffer from the disadvantage that they grip only the lid to be removed; the container must be gripped manually. Others are complex devices which are expensive to produce and/or which require an electric power source.

It is an aim of the present invention to overcome or alleviate some or all of the problems associated with the known devices.

In accordance with the present invention, there is provided a device for loosening threaded lids from correspondingly threaded containers, comprising a body carrying first and second flexible belts forming first and second loops which engage around the lid and the container respectively, the belts being arranged to be relatively displaceable such that the first and second loops grip the lid and the container respectively, the belts further being arranged to be displaceable by an actuating means such that the first and second loops apply oppositely directed torques to the lid and container respectively whereby the lid is rotated on the container in a loosening direction.

Such a device has the advantage that both the lid and the container are gripped by the device rather than by the hand. The loosening of the lid may be achieved by the rotation of only one of the loops relative to the body, the other loop serving to prevent rotation of the lid or the container relative to the body. Alternatively, both of the loops may rotate relative to the body in opposite directions.

Preferably, the device may further comprise a tongue adapted to stabilise the container from which the lid is being removed by engaging therewith.

The belts may, for example, be thin metal belts having a coating of a friction material, e.g. a rubber material.

In a preferred embodiment, the actuating means comprises a block to which an end of each of the two belts is attached, there being further provided displacing means for displacing the block.

In another preferred embodiment, the displacing means comprises a shaft adapted to be rotated, preferably manually, whereby causing at least one of the loops to rotate relative to the body.

In one embodiment, the displacing means comprises a pinion gear rotatably mounted to the block, which pinion gear engages with a rack gear provided in the body, the pinion gear being rotatable by a turning means.

In another embodiment, the displacing means comprises a bar connected to a lever.

The actuating means may also comprise a ratchet mechanism such that the device may be operated by rotating the shaft in alternating directions.

In an alternative embodiment, the shaft comprises two rotatable surfaces around which the first and second belts may be wound in opposite directions.

In a further alternative embodiment, the actuating means comprises two contra-rotatable shafts, one end of the first belt being attached to one of the shafts and one end of the second belt being attached to the second of the shafts, the second ends of the two belts being attached to the body, preferably via respective resilient means, e.g. extension springs.

In further alternative embodiments, the loops may be caused to rotate relative to one another by virtue of the ends of the loops being driven in another manner, for example by being pulled between a pair of rollers which may be knurled, or by being drawn by a block moved by a lever or a rack and pinion gear assembly.

Preferably, the two resilient means are attached to the body via respective anchor posts. The position of the anchor posts on the body are preferably moveable, whereby the sizes of the loops may be adjusted to accommodate different sizes of container/lid.

Still more preferably, the contra-rotation means comprises a gear system, preferably comprising two meshed spur gears.

Preferably, the device comprises a handle connected to or incorporating the body.

In order to enable a sufficient frictional force to develop between the belt and the lid, it is preferable for the belts to contact a large proportion of the circumference of the lid and container, respectively. For example, the belts may contact at least 50% of the circumference of the lid and container. This may preferably be achieved by the provision of rollers mounted on the body against which the rollers sit.

Specific embodiments of the invention will now be described, by way of example only, with reference to the accompanying drawings, in which.

Figure 1:
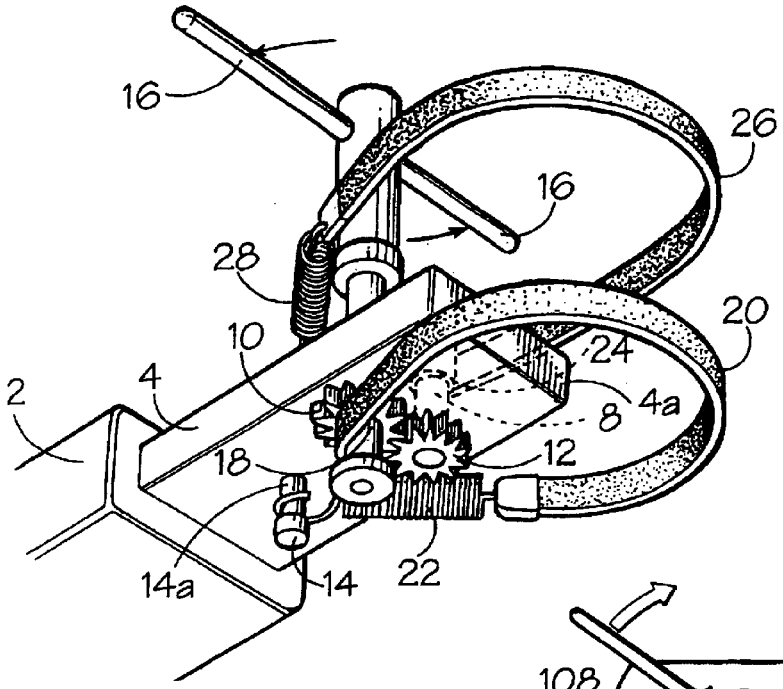
FIG. 1 is a perspective view from below of a first embodiment of the invention.

The embodiment shown in FIG. 1 comprises a handle 2 having a portion extending from one end in the form of a plate 4. Rotatably mounted through the plate 4 and disposed parallel to one another are a main shaft 6 and a counter shaft 8. Both shafts 6, 8 extend above and below plate 4 and bear, below plate 4, a drive spur gear 10 and an identically sized driven spur gear 12, respectively. Gears 10, 12 are meshed together such that rotation of one shaft 6, 8 causes contra-rotation of the other.

Disposed between the shafts 6, 8 on the one hand and the handle 2 on the other, there is mounted an anchor post 14 which also extends above and below plate 4.

Above the plate 4, the main shaft 6 is provided with a T-bar 16, to facilitate manual rotation of the main shaft 6.

Below the plate 4 and the gear 10, the main shaft 6 is provided with a cylindrical surface 18 to which is attached an end of a first rubber belt 20, the other end of which is attached, via a first extension spring 22 to a portion 14*a* of the anchor post 14 which extends below the plate 4.

The counter shaft 8 is also provided, above the plate 4, with a cylindrical surface 24 to which is attached an end of a second rubber belt 26, the other end of which is connected via a second extension spring 28 to a portion 14*b* (not shown) of anchor post 14 which extends above plate 4.

The belts 20, 26 thus form substantially "U"-shaped loops extending away from the handle 2 and beyond the end of the plate 4.

To use this embodiment to remove the lid from a jar, belts 20 and 26 are placed around the jar and the perimeter of the lid respectively such that a portion 4*a* of the plate 4 is in contact with the neck of the jar just below the lid.

The main shaft 6 is rotated using the T-bar 16 such that the belt 20 is wound onto surface 18 of the main shaft 6 and the belt 26 is wound onto the surface 24 of the counter shaft 8

Because of the counter rotation of shafts 6, 8, when the loops formed by belts 20, 26 are pulled tight around the jar and lid respectively, torques of opposite directions are applied to the jar and lid.

In the embodiment shown, for loosening right-handed threads, the torque applied to the lid, viewed from below, is anti-clockwise and the torque applied to the jar is clockwise.

The belts 20 and 26 grip the jar and lid respectively and the applied torque causes counter rotation of the jar and lid relative to the other, thereby loosening the lid from the jar. The lid may then be removed from the jar manually.

Figure 2:
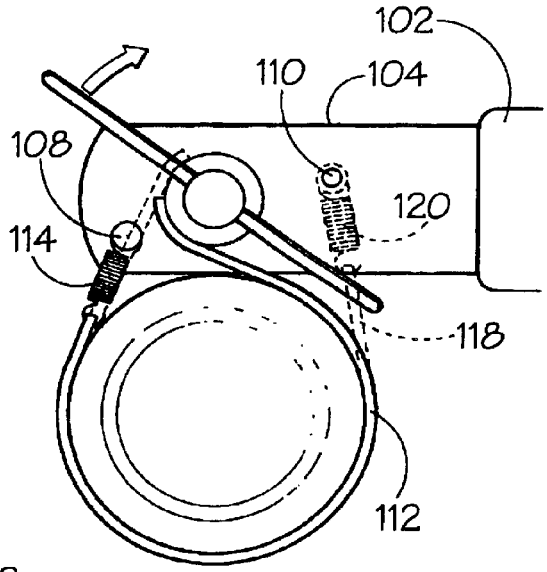
FIG. 2 is a plan view of a second embodiment of the invention in use.
Figure 3:
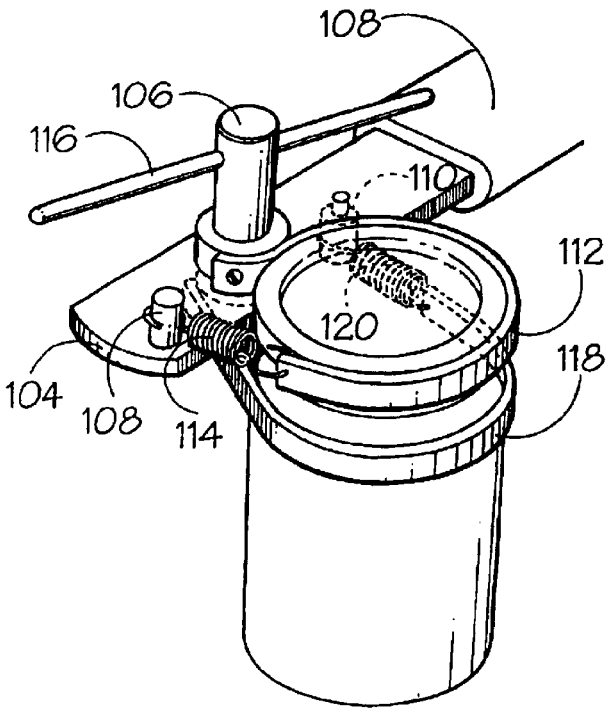
FIG. 3 is a perspective view of the embodiment shown in FIG. 2 in use.

FIGS. 2 and 3 show a second embodiment comprising a handle 102 from which extends a portion in the form of an elongate plate 104. Rotatably mounted through the plate 104 and perpendicular thereto is a shaft 106 carrying a T-bar 116.

Extending from the upper and lower surfaces of plate 104 are a first anchor post 108 and a second anchor post 110, respectively. The second anchor post 110, the shaft 106 and the first anchor post 108 are arranged progressively further distant from handle 102.

A first flexible, elongate belt 112 has one end attached via an extension spring 114, to the first anchor post 108. The other end of the belt 112 is attached to the shaft 106 above the plate 104.

A second flexible, elongate belt 118 is attached at one end, via extension spring 120, to the second anchor post 110 and at the other end to the shaft 106 below the plate 104. The first and second belts 112, 118 form substantially "U"-shaped loops extending from a long edge of the plate 104.

This embodiment is used in a manner similar to that described above for the first embodiment.

Figure 4:
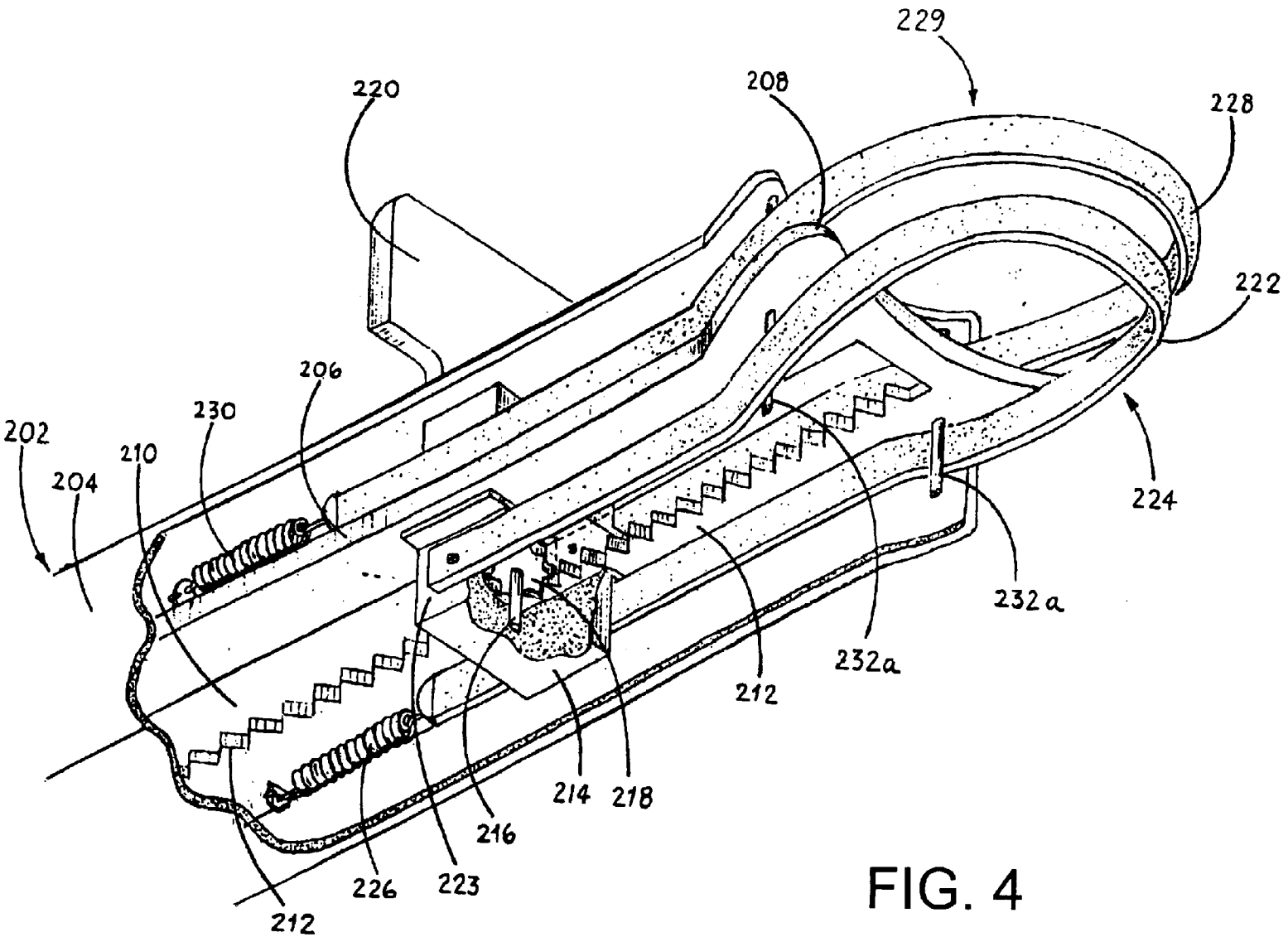
FIG. 4 is a perspective view from below of a third embodiment of the invention.
Figure 5:
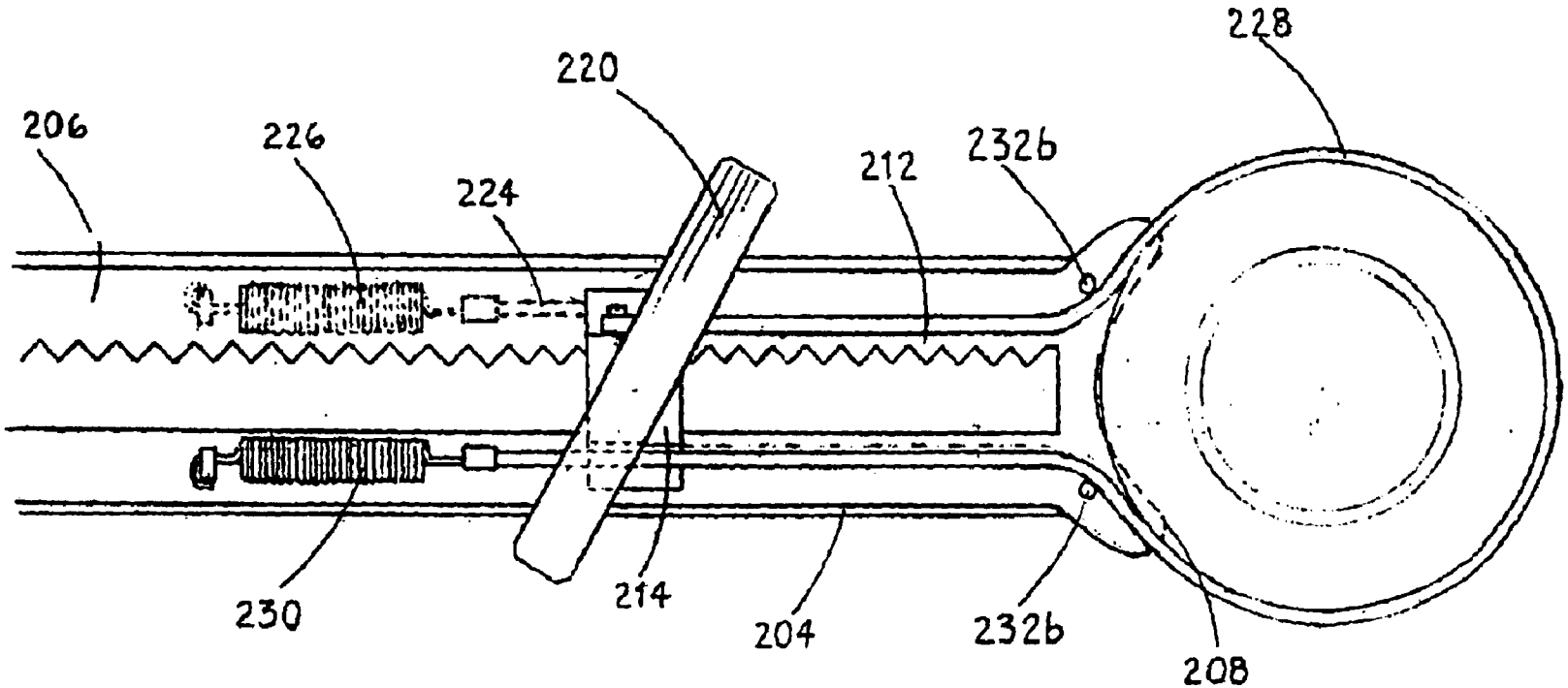
FIG. 5 is a plan view from above of the embodiment shown in FIG. 4 in use.

The third embodiment, shown in FIGS. 4 and 5 comprises a handle 202 in the form of a hollow plastics housing 204. Mounted within the housing 204 is a plate 206, an end portion 208 of which protrudes from the housing 204. An elongate slot 210 is provided in the plate 206. Along one long edge of the slot 210 are teeth forming a rack gear 212.

A mounting block 214 is slidably mounted within the slot 210. Within the block is a shaft 216 keyed to which is a pinion gear 218 which is free to rotate relative to the block 214 and which engages with the rack gear 212.

A turning means 220 is mounted on an end of the shaft 216, the turning of which causes rotation of the shaft 216 and the pinion gear 218, which results in lateral movement of the mounting block 214 in a longitudinal direction relative to the plate 206. The turning means 220 shown in FIGS. 3 and 4 is substantially T-shaped and is formed of a plastics material.

A first end of a first elongate rubber belt 222 is attached to a lower portion of the block 214 which extends from the plate 206 on its side remote from the turning means 220, the first belt 222 being attached to a side 223 of the block 214 remote from the rack gear 212. The first belt 222 extends within the housing 204 from the mounting block 214 towards the end portion 208 of the plate 206 adjacent which it protrudes from the housing 204 and forms a loop 224. The second end of the first belt 222 re-enters the housing 204 and is attached to the underside of the plate 206 via a first spring 226.

A first end of a second elongate rubber belt 228 is attached to an upper portion of the block 214 on a side of the block adjacent the rack gear 212. The second belt 228 forms a second loop 229 adjacent the end portion 208 of the plate 206 and the second end of the second belt 228 is attached to the upper side of the plate 206 via a second spring 230.

Lateral movement of the belts 222 and 228 may be constrained by rollers 232*a* (in FIG. 4) or 232*b* (in FIG. 5) respectively, or both.

In order to use this embodiment to loosen the lid from a jar, the U-shaped loops formed by the first and second belts 222, 228 are arranged around the jar and lid respectively. The end portion 208 of the plate 206 sits a short distance between the lid of the jar and abuts the neck of the jar.

The turning means 220 is turned in a clockwise direction (when viewed from above as in FIG. 5) and the block 214 moves away from the end portion 208 of the plate 206 thus reducing the size of the loops formed by the first and second belts 222, 228. When the slack has been removed from the belts, rotation of the turning means 220 is continued, and the belts grip the jar and the lid and apply oppositely directed torques as in the above-described embodiments.

When the lid has been loosened from the jar, the turning means 220 is turned in an anti-clockwise direction (when viewed from above as in FIG. 5) and the loops formed by the belts 222, 228 increase in size. The jar and lid are removed from the belts and the lid is removed from the jar by hand.

It will be evident that this embodiment could equally be made so that loosening of the lid is achieved by an anti-clockwise rotation of the turning means 220 rather than a clockwise rotation as described.

Figure 6:
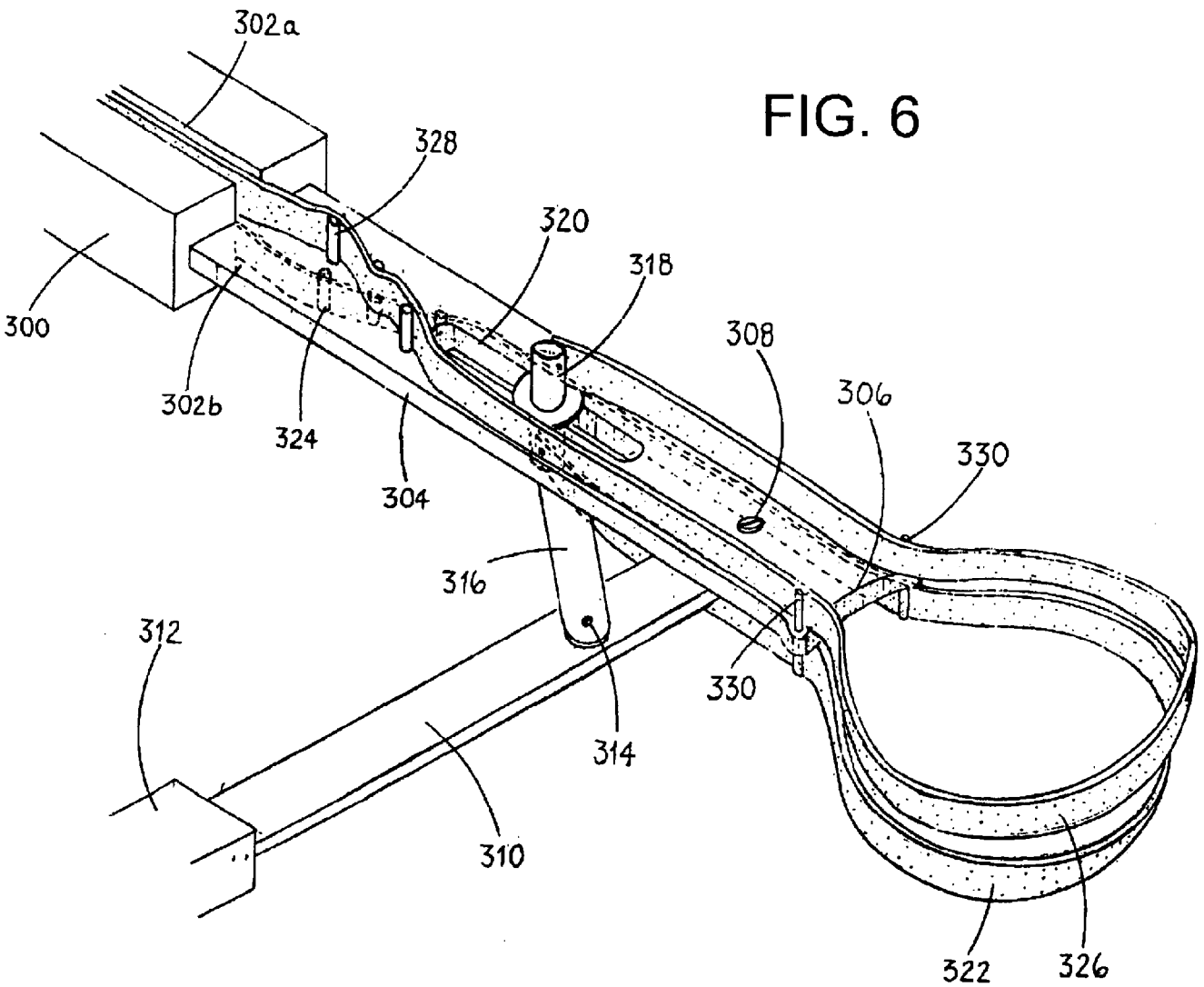
FIG. 6 is a perspective view of a fourth embodiment of the invention.

FIG. 6 shows a fourth embodiment of the invention in perspective. This embodiment comprises a first handle 300 having respective substantially U-shaped channels 302*a*, 302*b* disposed in the upper and lower surfaces respectively thereof. A plate 304 extends from an end of the handle 300, the remote end of which plate 304 forms an end portion 306.

Towards the end portion 306 of the plate 304 is disposed a first pivot 308, rotatably mounted to which is a side arm 310 having disposed at its end remote from the first pivot 308 a second handle 312. A second pivot 314 is provided on the side arm 310 between the first pivot 308 and the second handle 312. Rotatably mounted to the second pivot 314 is a first end of a bar 316. Rotatably mounted to the second end of the bar 316 is a block 318 which is slidably mounted in an elongate slot 320 provided in the plate 304 between the first pivot 308 and the first handle 300, which block 318 extends both above and below the plate 304.

The arrangement so far described is such that when the first and second handles 300, 312 are brought together, the block 318 moves towards the end of the slot 320 adjacent the first handle 300. As the angle between the plate 304 and the side arm 310 increases, the block 318 moves away from the first handle 300.

An end of a first rubber belt 322 is attached to the lower portion of the block 318 on its side adjacent the side arm 310. The first belt 322 extends towards and beyond the end portion 306 of the plate 304 where it forms a loop. The first belt 322 then returns and passes along the underside of the plate 304 where it passes through a first set of three friction rollers 324 disposed on the underside of the plate 304 and through the channel 302*b* in the underside of the first handle 300.

An end of a second belt 326 is attached to the upper portion of the block 318 on its side remote from the side arm 310. The second belt 326 forms a loop in a similar manner and also passes through a second set of three friction rollers 328 disposed on the upper surface of the plate 304 and then through the channel 302*a* in the upper surface of the first handle 300.

In order to use this embodiment, the side arm 310 is moved away from plate 304 such that the block 318 is situated towards the end of the slot 320 remote from the first handle, the first belt 322 is arranged around the jar and the second belt 326 is arranged around the lid. The end portion 306 of the plate 304 sits beneath the lid adjacent the neck of the jar.

Free ends of the first and second belts 322, 326 which extend beyond the first handle are pulled independently of one another such that they grip the jar and lid respectively. The first and second belts 322, 326 are prevented from loosening by their engagement with the first and second sets of friction rollers 324, 328.

Contact between a large proportion of the circumference of the jar and lid with the respective belts is ensured by rollers 330 fixed to the end portion 306 of the plate 304.

The first and second handles are then brought together such that the block 318 moves towards the first handle 300. The block 318 pulls the first and second belts such that they respectively impart a clockwise and an anti-clockwise torque upon the jar and the lid, thereby loosening the lid from the jar.

What is claimed is:

1. A device for loosening a threaded lid from a correspondingly threaded container, comprising a body, first and second flexible belts carried by the body and forming first and second loops for engaging around the lid and the container respectively, the belts being arranged to be relatively displaceable such that the first and second loops grip the lid and the container respectively, the belts further being arranged to be displaceable by an actuating means such that the first and second loops apply oppositely directed torques to the lid and container respectively whereby the lid is rotated on the container in a loosening direction.

2. A device as claimed in claim 1, wherein the loosening of the lid is achieved by the rotation of both of the loops relative to the body, in opposite directions.

3. A device as claimed in claim 2, wherein the actuating means comprises two contra-rotatable shafts, one end of the first belt being attached to one of the shafts and one end of the second belt being attached to the second of the shafts, the second ends of the two belts being attached to the body.

4. A device as claimed in claim 3, wherein the second ends of the belts are attached to the body via respective resilient means.

5. A device as claimed in claim 3, wherein the contra-rotation means comprises a gear system, comprising two meshed spur gears.

6. A device as claimed in claim 2, wherein the actuating means comprises a rotatable shaft having two circumferential surfaces around which the first and second belts may be selectively wound in opposite directions.

7. A device as claimed in claim 2, wherein the actuating means causes the loops to be rotated relative to one another by virtue of at least one end of each loop being drawn between a pair of rollers, or by being drawn by a block moved by a lever or a rack and pinion gear assembly.

8. A device as claimed in claim 7, wherein the actuating means comprises a block to which an end of each of the two belts is attached, there being further provided a displacing means for displacing the block.

9. A device as claimed in claim 8, wherein the other ends of the belts are attached to the body via respective resilient means.

10. A device as claimed in claim 9, wherein the two resilient means are attached to the body via respective anchor posts.

11. A device as claimed in claim 10, wherein the positions of the anchor posts on the body are moveable, whereby the sizes of the loops may be adjusted to accommodate different sizes of container/lid.

12. A device as claimed in claim 8, wherein the displacing means comprises a pinion gear rotatably mounted to the block, which pinion gear engages with a rack gear provided in the body, the pinion gear being rotatable by a turning means.

13. A device as claimed in claim 8, wherein the displacing means comprises a bar connected to a lever.

14. A device as claimed in claim 1, wherein the actuating means comprises a ratchet mechanism such that the device may be operated by rotating the shaft in alternating directions.

15. A device as claimed in claim 1, further comprising a tongue adapted to stabilize the container from which the lid is being removed by engaging with the container.

16. A device as claimed in claim 1, wherein the belts are thin metal belts having a coating of a friction material.

17. A device as claimed in claim 1, further comprising a handle connected to or incorporating the body.

18. A device as claimed in claim 1, wherein the loosening of the lid is achieved by the rotation of only one of the loops relative to the body, the other loop serving to prevent rotation of the lid or the container relative to the body.

* * * * *